US007225569B2

(12) United States Patent
Pitt et al.

(10) Patent No.: US 7,225,569 B2
(45) Date of Patent: Jun. 5, 2007

(54) FLEXIBLE FRAME AND MUTUALLY ENGAGEABLE FASTENING MEANS

(75) Inventors: John Dunlop Pitt, Newlands (GB); David Lutton, Hillhead (GB); Gillian Durham, Langside (GB)

(73) Assignee: Agripa Holdings Limited, Glasgow (GB)

( * ) Notice: Subject to any disclaimer, the term of this patent is extended or adjusted under 35 U.S.C. 154(b) by 0 days.

(21) Appl. No.: 11/204,782

(22) Filed: Aug. 16, 2005

(65) Prior Publication Data

US 2006/0090386 A1 May 4, 2006

(30) Foreign Application Priority Data

Oct. 28, 2004 (GB) ..... 0423899.4

(51) Int. Cl.
*G09F 17/00* (2006.01)

(52) U.S. Cl. ..... 40/603; 40/590; 40/604; 160/327; 160/328

(58) Field of Classification Search ..... 40/541, 40/590, 603; 160/327, 328, 378
See application file for complete search history.

(56) References Cited

U.S. PATENT DOCUMENTS

| | | | | |
|---|---|---|---|---|
| 3,782,872 | A | 1/1974 | Nalle, Jr. | |
| 3,849,840 | A | 11/1974 | Yamada et al. | |
| 4,162,100 | A | 7/1979 | Muscillo | |
| 4,800,947 | A * | 1/1989 | Loomis | 160/368.1 |
| 4,930,834 | A | 6/1990 | Moore | |
| 5,058,299 | A | 10/1991 | Suzuki | |
| 5,226,251 | A | 7/1993 | Webb | |
| 5,239,765 | A | 8/1993 | Opdahl | |
| 5,241,977 | A | 9/1993 | Flores et al. | |
| 5,384,939 | A * | 1/1995 | Weber | 24/306 |
| 5,398,437 | A | 3/1995 | Bump, Jr. et al. | |
| 5,415,451 | A | 5/1995 | Stanton | |
| 5,507,109 | A * | 4/1996 | Rinzler | 40/603 |
| 5,611,122 | A * | 3/1997 | Torigoe et al. | 24/442 |
| 5,657,566 | A | 8/1997 | Key | |
| 5,671,511 | A * | 9/1997 | Hattori et al. | 24/444 |
| 5,743,700 | A | 4/1998 | Wood, Jr. et al. | |
| 5,845,423 | A | 12/1998 | Hicks | |
| 6,092,319 | A | 7/2000 | Hicks | |
| 6,101,751 | A * | 8/2000 | Hicks | 40/590 |
| 6,167,649 | B1 | 1/2001 | Palmeri | |
| 6,276,082 | B1 * | 8/2001 | Richards et al. | 40/603 |
| 6,687,962 | B2 * | 2/2004 | Clarner et al. | 24/452 |
| 6,904,709 | B2 * | 6/2005 | Craig et al. | 40/590 |
| 2004/0231208 | A1 | 11/2004 | Pitt | |

FOREIGN PATENT DOCUMENTS

| | | |
|---|---|---|
| DE | 41 13 481 A1 | 4/1991 |
| DE | 19711834 A1 | 3/1997 |
| DE | 19851720 A1 | 11/1998 |
| EP | 0 078 391 | 9/1982 |
| EP | 0 213 396 | 7/1986 |

(Continued)

*Primary Examiner*—Robert J. Sandy
*Assistant Examiner*—Marcus Menezes
(74) *Attorney, Agent, or Firm*—Drinker Biddle & Reath LLP

(57) ABSTRACT

A flexible frame for an advertising panel is described. The flexible frame has a mutually engageable fastening means, especially, but not exclusively for attachment to a vehicle. The flexible frame could alternatively be attached to a fixed structure.

23 Claims, 4 Drawing Sheets

FOREIGN PATENT DOCUMENTS

| | | | |
|---|---|---|---|
| EP | 0 382 478 | A2 | 2/1990 |
| EP | 0 382 478 | A3 | 2/1990 |
| EP | 0473794 | | 10/1996 |
| EP | 1 010 587 | A1 | 12/1999 |
| EP | 1376518 | | 1/2004 |
| EP | 1 408 477 | A2 | 4/2004 |
| FR | 2 598 241 | A1 | 4/1986 |
| JP | 08190355 | A | 7/1996 |
| JP | 10049089 | A | 2/1998 |
| JP | 11259030 | A | 9/1999 |
| WO | WO 96/38832 | | 12/1996 |
| WO | WO98/39759 | | 9/1998 |
| WO | WO00/57394 | | 9/2000 |
| WO | WO 00/64296 | | 11/2000 |
| WO | WO 03/069592 | | 8/2003 |

* cited by examiner

Fig. 1
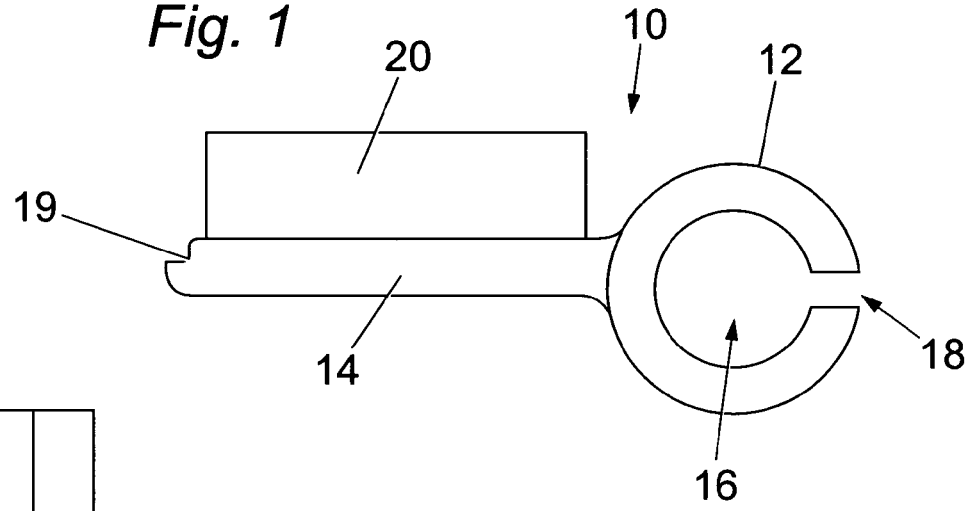
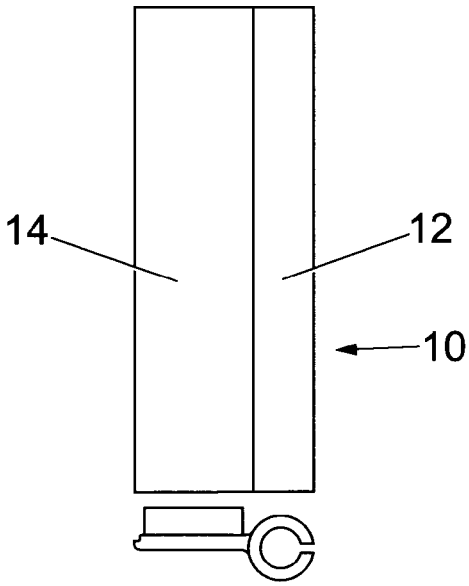
Fig. 2
Fig. 3
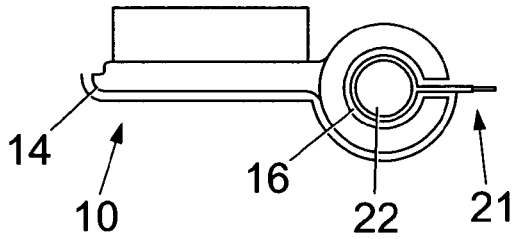

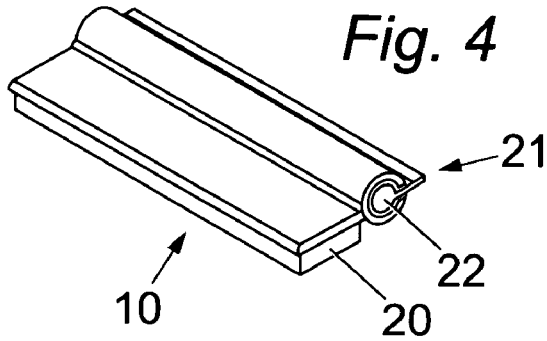
Fig. 4
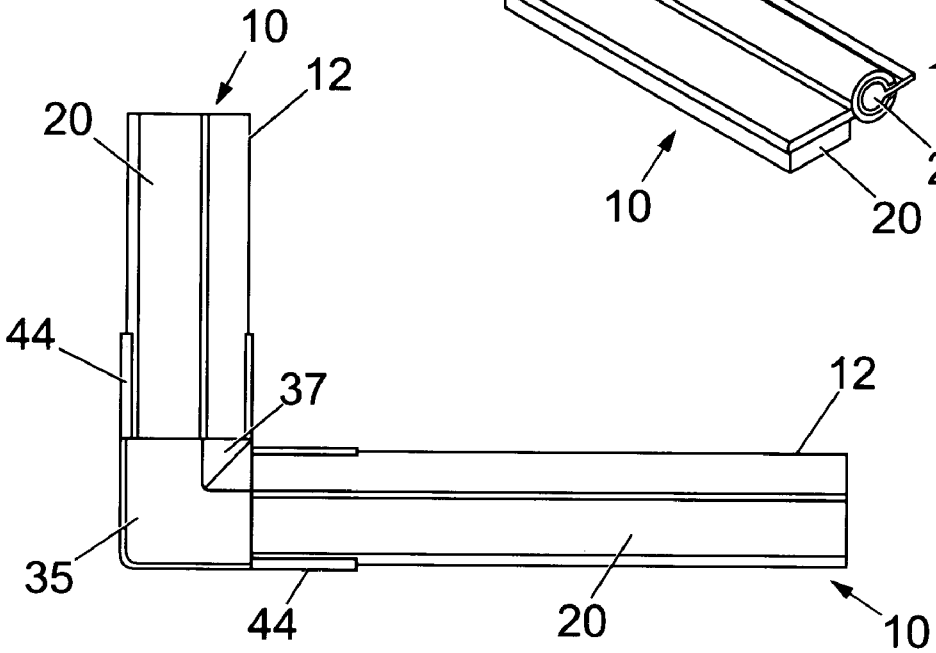
Fig. 5
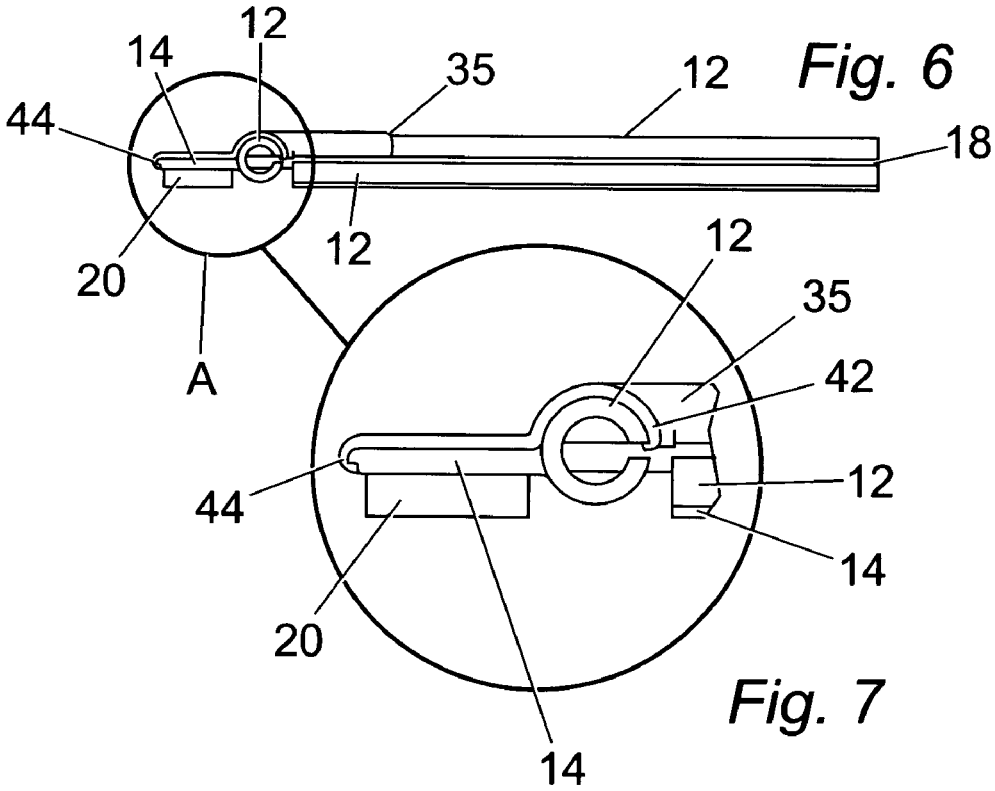
Fig. 6
Fig. 7

42

14
19
44

35
44
37
42

42
35
37
36
44
42
44

35

35
36
37
42
37
42
36
44
44

35
37
36

35

FLEXIBLE FRAME AND MUTUALLY ENGAGEABLE FASTENING MEANS

FIELD OF THE INVENTION

This invention relates to a flexible frame for an advertising panel, the frame having a mutually engageable fastening means, especially, but not exclusively for attachment to a vehicle.

DESCRIPTION OF THE RELATED ART

It is known to make an advertising panel by permanently bonding a printed vinyl panel to a mounting board. In the case of vehicles, the mounting board typically comprises a reinforced cardboard board (e.g. a corex board), which is slid into a frame mounted on the vehicle. When the advert needs to be changed, the vinyl panel must first be removed. In cold weather, the vinyl becomes brittle and breaks up, which makes removal both difficult and time consuming.

In the case of long vehicles (e.g. buses), the advertising panels span a large proportion of the length of the vehicle and are of the order of five to ten meters in length. It is not practical to make such long advertising panel/supporting boards, so these are typically made in five or more portions. This means that unwanted vertical lines are visible between neighbouring portions, which break up the image. Between neighbouring portions, plastic T-covers are affixed to cover any gaps and to space the portions correctly. However, when these T-covers break, they become discoloured, which is detrimental to the appearance of the advertising panel.

It is also known from EP 0,473,794 to mount a poster on a lorry, the poster having a rod-shaped frame at each edge using c-shaped attachment members which have spaces for receiving the rod-shaped frames and slits which allow the poster to extend therethrough. The c-shaped attachment members are not themselves directly fixed to the structure; instead they have slots which receive a hook of a mounting adjuster. The mounting adjuster has a further hook which engages the cross sill at the periphery of the side wall of the lorry.

This design has several disadvantages. The poster needs to be very strong, in order not to break when the force on the poster is increased by the tightening of the adjuster, and to keep the hook in place by exerting a force on the hook.

As this device requires hooks, the poster edges must be located reasonably close to the edge of the lorry. No edge of the poster could be located at a location which is not near a co-operating member around which the hooks could grip. Therefore, this device could not be used on a planar structure at a location far from a specially designed bar or perpendicular edge to which the hooks could be attached. Therefore, this device is very limited in possible applications and is, for example, entirely unsuitable for use on buses.

Furthermore, the design is potentially dangerous as if any part of the poster were to rip, this would release the force on the hooks of one or all of the mounting adjusters, which may fall off the lorry, possibly with the c-shaped attachment members too. Parts of metal flying off a fast-moving lorry could be extremely dangerous.

The poster mounting device is complex and has an excessive number of components, as not only does it require one c-shaped attachment member for each edge, but each of these attachments members requires at least two mounting adjusters for attachment to the lorry.

In embodiments which do not use a c-shaped attachment member for the top of the poster, a frame 23 is instead permanently welded to the lorry. This involves a drastic alteration to the lorry and would be entirely unsuitable for situations where the advertisements are only required over a temporary period.

In an alternative embodiment also disclosed in EP 0,473,794, modified rails are provided for engagement with rod-shaped frames fitted on the top and the bottom edges of the poster. The rails are elongate, and have recesses to receive the rod-shaped frames, and slots through which the poster extends. However, these modified rails are also permanently welded onto the body of the lorry, so these rails cannot easily be removed from the structure if it is desired to cease the advertising activities.

Furthermore, these rails can only be used for the top and the bottom edges of the poster, because once the poster has been slotted into the top and bottom rails, the position of the left and right edges of the poster are fixed and cannot be moved upwards or downwards to slot into any further rails. Therefore, this embodiment cannot provide a complete frame around all edges of the poster. For the left and right hand edges, velvet, magic type fasteners or snap type fasteners are used instead of a frame; these fix the poster directly to the lorry. This is a much weaker connection as compared to having a frame member on each edge of the poster, and may allow air to get in behind the poster, increasing the air resistance of the lorry and the air force acting on the poster.

BRIEF SUMMARY OF THE INVENTION

According to a first aspect of the invention there is provided an advertising system comprising:

- a frame for mounting an advertising panel on a structure, the frame comprising at least one frame member; and
- a mutually engageable fastening means comprising first and second fasteners, the second fastener being affixable to the structure;
- wherein the first fastener is provided on a flexible part of the frame, the flexibility of the frame and the mutual engagement strength of the first and second fasteners being such that the frame and first fastener may be separated from the second fastener by peeling action; and
- wherein the frame is adapted to releaseably engage an advertising panel.

The frame being adapted to "releaseably engage" an advertising panel means that the advertising panel and the frame can be repeatedly engaged and disengaged, in contrast to a frame that is permanently fixed to the advertising panel, or a frame that comprises a part of the advertising panel.

Optionally, more than one frame member is provided. Optionally, a respective frame member is provided for each edge of the advertising panel, the frame members typically having substantially the same length as their respective edges.

Preferably, the flexible part of the frame comprises a flange.

In some embodiments, the whole of the frame has at least some flexibility. Such embodiments can be mounted on non-flat surfaces, for example on the curved exterior surface of a tanker, e.g. an oil tanker, or on other cylindrical/curved surfaces.

Preferably, the or each frame member has a panel-receiving portion, which is adapted to receive an edge of an advertising panel, and which is more rigid than the flexible part of the frame member. Typically, the flexible part of the frame and the panel-receiving portion comprise different materials. The panel-receiving portion being more rigid can help prevent the panel from becoming accidentally detached from the frame member. Preferably, the panel-receiving portion is not completely rigid and has some flexibility, so that it can bend to some extent with the flexing of the fastener part of the frame member. If the entire frame has some flexibility, this enables it to be mounted on a curved surface, for example on the convex surface of a tanker. Mounting on a concave surface is also possible.

Optionally, the frame comprises PVC.

Optionally, the frame comprises a thermoplastic elastomer.

Optionally, the frame comprises Sunprene™, which is a thermoplastic elastomer based on a high molecular weight PVC resin.

Optionally, the frame comprises a thermal plastic, or a material having similar properties to a thermal plastic.

Preferably, the frame comprises two different portions with different flexibilities, which are bonded together; a comparatively more flexible type for the fastener part of the frame and a less flexible type for the panel-receiving portion.

Optionally, the frame member has a recess to receive a protrusion on an advertising panel edge. Preferably, the frame member has an elongate slot that is small enough to retain the protrusion in the slot, but which is large enough to allow a planar part of the advertising panel to extend through the slot. Preferably, the frame member has at least one open end, so that the protrusion can be inserted into the recess.

Preferably, the frame members comprise track members.

Preferably, the mutually engageable fastening means comprises a mechanical fastener. Preferably, the mechanical fastener is releasably engageable, as opposed to providing a permanent engagement. Preferably, the mechanical fastener is engaged by pushing the first and second fasteners together and disengaged by pulling them apart.

In such embodiments, because the first fastener is provided on a flexible part of the frame, the frame can bend as the first and second fasteners are engaged and disengaged. This provides the advantage that the force does not have to be applied simultaneously along the entire length of the fasteners. Instead, the fasteners can be engaged at a first location by the application of a force on a relatively small area. As the force can act on a small area due to the flexing of the frame, a relatively small force can be used to create the threshold engagement pressure. In preferred embodiments, this force can be provided manually by a single person, without needing complex apparatus. The force can then be transferred along the length of the fasteners to successively engage more of the fasteners until eventually, preferably the entire length of the fasteners are engaged. On disengagement of the first and second fasteners, the flexibility of the frame allows the frame and first fastener to be separated from the second fastener by peeling action.

Preferably, the first and second fasteners have mushroom-shaped barbs, which interlock when the first and second fasteners are pressed into engagement. Preferably, the mushroom-shaped barbs are arranged in rows and columns, and in one of the first and second fasteners, the rows and columns form straight lines, and in the other fastener, the mushroom-shaped barbs in each row and column are offset relative to their neighbours. Preferably, the mutually engageable fastening means comprises a 3M™ Dual Lock™ system.

According to a second aspect of the present invention, there is provided a method of mounting a frame on a structure, the frame being suitable for releasably engaging an advertising panel, the method comprising the steps of:

affixing a first elongate fastener to a flexible part of the frame;

affixing a second elongate fastener to the structure, the second fastener being engageable with the first fastener;

applying pressure at a first location to engage the first and second fasteners at that location, and transferring the pressure along the length of the fasteners to successively engage a larger proportion of the fasteners.

Typically, the pressure is transferred using a roller.

Such embodiments have the advantage that the frame can be mounted on the structure by a single person. Preferably, the frame is releasably mounted on the structure such that it can be dismounted when desired. In some embodiments, the frame can be easily mounted and removed with ease, as often as necessary. Using such a frame to mount an advertising panel can make it very easy to replace the advertising panel with another panel to change the advert.

Preferably, the frame members include panel-receiving portions, and the method includes the further step of installing an advertising panel in the frame. Typically, the advertising panel has a planar portion and a protrusion on a panel edge, and the panel-receiving portion has an elongate recess having an opening at one end to receive the protrusion, and the method includes the step of threading the protrusion through the end opening and into the recess.

Optionally, the frame comprises a plurality of frame members and a respective frame member is provided for attachment to each edge of the advertising panel.

Optionally, a frame member is mounted on the structure before attachment to its advertising panel edge. Alternatively, the frame member is attached to the advertising panel before the frame member is mounted on the structure. A combination of both these methods can be used to mount all edges of the panel to the structure, even when the advertising panel edges have to be threaded through the frame members from one end.

Optionally, the method includes the successive steps of mounting one or more of the frame members on the structure and attaching the rest of the frame members to the advertising panel, attaching the advertising panel to the mounted frame member(s), and subsequently mounting the rest of the frame members on the structure. Alternatively, all of the frame members are attached to the advertising panel before mounting any of the frame members on the structure.

Optionally, only a first frame member is mounted on the structure before being attached to the advertising panel.

Typically, the method includes the successive steps of:

mounting the first frame member on the structure;

attaching an edge of the advertising panel to the first frame member and attaching an opposite edge of the advertising panel to a second frame member;

tensioning the advertising panel; and mounting the second frame member on the structure.

Tensioning the advertising panel ensures that the mounted advertising panel does not sag. This method enables an easier mounting of the advertising panel, as it does not require any simultaneous engagement with more than one already-mounted frame members, and it does not require the advertising panel to be pulled taut at the same time as simultaneously engaging two already-mounted frame members.

Optionally, the method includes the further steps of attaching a respective further frame member to each remaining edge of the advertising panel and then mounting these further frame members on the structure.

Optionally, the structure comprises a vehicle, e.g. a bus, a lorry, a car, a van, a bike, a tanker; however these are simply examples and the invention is not limited to a vehicle, or to any particular type of vehicle.

Optionally, the frame is mounted on a curved surface of the structure, e.g. the curved exterior surface of an oil tanker.

Optionally, the advertising panel is rectangular, but the invention is not limited to any particular shape of advertising panel.

Alternatively, the advertising panel is T-shaped, and one frame member is provided for each edge of the T-shape.

According to a third aspect of the present invention, there is provided a method of mounting an advertising panel on a structure, comprising the steps of:

engaging a first edge of the advertising panel with a slotted track of a first frame member attached to a structure;

engaging a second edge of the advertising panel with a slotted track of a second frame member not attached to the structure;

engaging a first elongate fastener affixed to a flexible part of the second frame member with a second elongate fastener affixed to the structure;

applying pressure at a first location to engage the first and second fasteners at that location, and transferring the pressure along the length of the fasteners to successively engage a larger proportion of the fasteners.

The frame having a flexible part means that in preferred embodiments, the fasteners can be engaged and disengaged upon application of relatively small forces (e.g. by hand). This is a significant advantage over rigid frames with mechanical fastening means, which often need to be hammered into engagement and which require use of a crow-bar to disengage.

According to a fourth aspect of the present invention there is provided a method of replacing an advertising panel attached to a structure by a frame, the frame comprising a plurality of frame members with attached first fasteners, the method including the steps of:

peeling at least one frame member and attached first fastener from a second fastener attached to the structure;

disengaging all frame members from the original advertising panel;

re-engaging the frame members with the replacement advertising panel; and re-attaching the peeled-off frame members to the structure by applying pressure at a first location to engage the first and second fasteners at that location, and transferring the pressure along the length of the fasteners to successively engage a larger proportion of the fasteners.

Typically, at least one frame member remains attached to the structure during the method.

Preferably, only one frame member remains attached to the structure during the method.

According to a fifth aspect of the present invention, there is provided an advertising system comprising:

an advertising panel;

a frame for mounting the advertising panel on a structure, the frame being releaseably engageable with the advertising panel and comprising at least one frame member;

a mutually engageable fastening means comprising first and second fasteners, the second fastener being affixable to the structure;

wherein the first fastener is provided on a flexible part of the frame, the flexibility of the frame and the mutual engagement strength of the first and second fasteners being such that the frame and first fastener may be separated from the second fastener by peeling action.

Preferably, the frame is a frame according to the first aspect of the invention.

Preferably, the advertising panel is flexible, such that it can be rolled up and easily transported.

Preferably, the advertising panel comprises synthetic paper. Preferably, the advertising panel comprises vinyl on a polyester mat. Such embodiments can be robust, cheap to create, and can be printed on easily, e.g. by screen printing. Alternatively, the advertising panel comprises a mesh. In some cases, where the advertising panel is very large, or is transported at high speed and may be subject to considerable air flow, a mesh may be advantageous to allow pressure equalisation on both sides of the panel. However, in most cases, a non-perforated (non-mesh) panel is adequate. The invention is not limited to any particular type of panel.

Preferably, the advertisement panel is translucent. Such embodiments can be back-lit.

Typically, the advertising panel has attachment means provided along each of its edges. Typically, the attachment means comprises a protrusion, which is engageable with a corresponding recess in the frame.

Preferably, the advertising panel has a planar portion and a protrusion along at least one edge. Most preferably, the advertising panel has a protrusion on each edge. Preferably, a respective frame member is provided to engage each panel edge.

Preferably, the advertising panel is mounted in the frame by engaging the protrusion on the advertising panel edge in a recess of the frame member. Preferably, the frame member has an elongate slot small enough to retain the protrusion, but large enough to allow the planar part of the advertising panel to extend through the slot. Preferably, the frame member has at least one open end, so that the protrusion can be inserted into the recess.

In embodiments in which the advertising panel is flexible, and which is used in conjunction with a slotted track/frame member, the advertising panel can be bent to enable threading through the slots, whilst part of the advertising panel is already attached to the structure.

According to a sixth aspect of the present invention there is provided an advertising system comprising:

a frame for mounting an advertising panel on a structure, the frame comprising at least one track member; and a mutually engageable fastening means comprising first and second fasteners, the second fastener being affixable to the structure, wherein the first fastener is provided on a flexible part of the track member, the flexibility of the track member and the mutual engagement strength of the first and second fasteners being such that the track member and first fastener may be separated from the second fastener by peeling action; and wherein the track member is adapted to receive an edge of an advertising panel to mount the advertising panel.

According to a seventh aspect of the present invention there is provided an advertising system comprising:

a frame for mounting an advertising panel on a structure, the frame comprising at least one frame member; and a mutually engageable fastening means comprising first and second interlocking fasteners, the second fastener being affixable to the structure;

wherein the frame member comprises a first portion adapted to engage an advertising panel and a second portion that is flexible and to which the first fastener is affixable, the flexibility of the frame and the mutual engagement strength of the first and second fasteners being such that the frame and first fastener may be separated from the second fastener by peeling action.

According to an eighth aspect of the present invention there is provided an advertising system comprising:

a frame for mounting an advertising panel on a structure, the frame comprising at least one frame member; and a mutually engageable fastening means comprising first and second fasteners, the second fastener being affixable to the structure;

wherein the frame comprises a flexible portion and a panel-receiving portion, the flexible portion comprising a first material and the panel-receiving portion comprising a second, less flexible material;

wherein the first fastener is provided on a flexible part of the frame, the flexibility of the frame and the mutual engagement strength of the first and second fasteners being such that the frame and first fastener may be separated from the second fastener by peeling action.

BRIEF DESCRIPTION OF THE SEVERAL VIEWS OF THE DRAWINGS

An embodiment of the invention will now be described, by way of example only, and with reference to the following drawings, in which:

FIG. 1 shows an end view of a frame according to the present invention;

FIG. 2 shows a plan view of the frame of FIG. 1;

FIG. 3 shows an end view of the frame of FIG. 1 having an advertising panel coupled thereto (only part of the advertising panel shown);

FIG. 4 shows a perspective front view of the frame and part of advertising panel of FIG. 3;

FIG. 5 shows a rear view of two frames of FIG. 1 and a connector;

FIG. 6 shows a side view the FIG. 5 arrangement, the view having certain parts of the connector removed for clarity;

FIG. 7 shows an enlarged view of part of FIG. 6, the part designated by the circle A;

FIGS. 16 to 20 show a method of mounting an advertising panel on a structure and a further embodiment in which an advertising panel is T-shaped and the structure is a bus.

DETAILED DESCRIPTION OF THE INVENTION

Figures 8, 9, 10, 11, 12, 13, 14, 15:
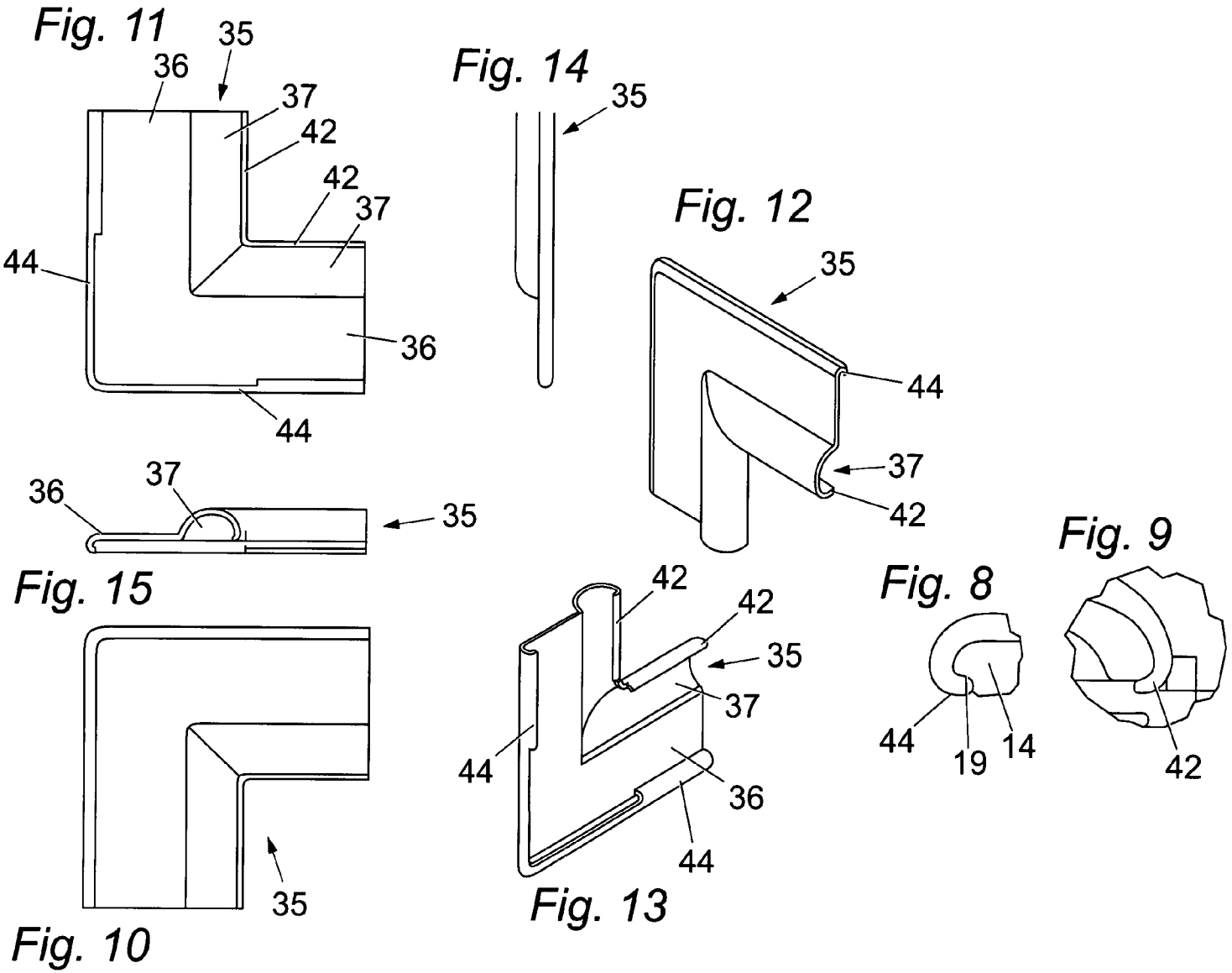
FIG. 8 shows an enlarged view of a first frame overhang of FIG. 7.
FIG. 9 shows an enlarged view of a second frame overhang of FIG. 7.
FIG. 10 shows a front view of the connector of FIG. 5.
FIG. 11 shows a rear view of the connector of FIG. 5.
FIGS. 12 and 13 show perspective views of the connector of FIG. 5.
FIGS. 14 and 15 show side views of the connector of FIG. 5.

Referring now to the drawings, FIG. 1 shows a frame member 10 comprising a panel-receiving portion 12 and a flange 14. The upper surfaces of FIG. 1 comprise the rear of the frame member 10 and the lower surfaces of FIG. 1 comprise the front of the frame member 10.

The panel-receiving portion 12 is c-shaped in cross-section, having a bore 16 with a circular cross-section and a slot 18. As can be seen in FIG. 2, the frame member 10 is elongate. The ends of the bore 16 are open. The panel-receiving portion 12 is relatively stiff but not totally rigid, and is typically made from high stiffness PVC or another plastics material. The invention is not limited to any particular material.

The flange 14 comprises low stiffness PVC, although other materials, e.g. flexible plastics, may also be used. It is preferable that the flange 14 is formed from a more flexible material than that used for the panel-receiving portion 12, for reasons which will be explained later. The flange 14 has a fastener 20 adhered or otherwise fixed to its rear surface (the upper surface in the FIG. 1 view). The fastener 20 is part of a mutually engageable fastening means; its co-operating fastener is not shown here. In this embodiment, the mutually engageable fastening means comprises a 3M™ Dual Lock™ fastening system, but any other suitable fastening means can be used. Dual Lock™ fasteners are available from 3M Industrial Adhesives and Tapes Division and include two interlocking fastener tapes, each tape having a series of stems with mushroom heads. The interlocking of the mushroom-shaped stems provides a high tensile strength connection. The flange 14 generally has a constant depth, except for a groove 19 cut out of the flange end farthest from the panel-receiving portion 12. The groove is in the surface of the flange 14 that carries the fastener 20 (the upper surface of the flange 14 in FIG. 1).

Figure 18:
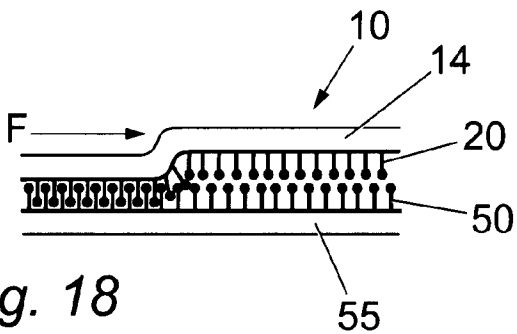

The fastener 20 and its co-operating fastener provide a mechanical fastening system. The fastener 20 and its co-operating fastener both comprise strips having mushroom-shaped barbs. When the fastener 20 and its co-operating fastener are pushed together, the heads of the barbs interlock and prevent the fasteners from coming apart, as shown in FIG. 18. The barbs on each fastener are arranged in rows and columns. On one of the fasteners, the barbs in each row and column are aligned, and on the other fastener, each barb is offset relative to its neighbours. This creates an even firmer bond when the barbs interlock.

The invention is not limited to this type of fastening means.

FIGS. 3 and 4 show the frame member 10 and a part of an advertising panel 21.

The advertising panel 21 typically comprises a sheet of plastic material. The sheet of plastic material may be perforated (i.e. a mesh) or non-perforated. The panel 21 is capable of being printed on, to provide an advertising image on one side. Any suitable printing process may be used, such as laser printing or screen printing. Non-perforated embodiments can be cheaper to make, as they do not require digital printing.

Typically, the panel 21 comprises a synthetic paper, e.g. vinyl on a polyester mat. Such panels 21 can be cheap to make, robust, and translucent, such that they can be backlit when mounted in a frame. Alternatively, the panel 21 comprises a mesh, such as described in WO 03/069592.

Reinforcing strips of reinforced PVC or similar material may be bonded to any or all of the edges of the panel 21 to prevent the panel 21 from tearing or stretching in use. The reinforcing strips may be bonded by adhesive or by ultrasonic welding. The strips may be of polypropylene or polyester scrim coated with PVC for easy joining to the panel 21. The thickness of the strips is chosen so that the panel 21 can be subject to the chosen printing process even with the strips attached. Typically the reinforcing strips are between 5 and 15 cm wide, and extend to the perimeter of the panel 21.

The advertising panel 21 (only a part of which is shown) has a respective protrusion 22 along the length of each of its edges.

The protrusion 22 has a circular cross-section and, in use, is received within the bore 16 (see FIG. 3). The diameter of the protrusion 22 is greater than the width of the slot 18, so the protrusion 22 cannot be removed from the bore 16 through the slot 18 without considerably deforming the slot 18. The protrusion 22 is insertable into, and removable from, the bore 16 via the open ends of the bore 16.

Preferably, a suitable stiff material is selected for the panel-receiving portion 12 so that it is stiff enough to prevent the slot 18 deforming sufficiently to allow the protrusion to pass through the slot 18. However, preferably the panel-receiving portion 12 has some degree of flexibility, to allow the panel-receiving portion 12 to flex in response to the flexing of the flange 14.

The protrusions 22 are bonded to the edges of the panel 21 with or without reinforcing strips, by wrapping the edge of the advertising panel 21 around the protrusion 22 and stitching with thread or bonding to form a hem, or by attaching and bonding an edge strip of any suitable plastic material. Thermal or adhesive bonding may be used. The protrusion 22 comprises a cord or rope, or extruded flexible plastic or rubber, held in the hem or edge strip. The cord or rope may be free to slide in the hem or edge strip, or may be restrained or bonded to the hem or edge strip. The edge strip may be of the same material as the reinforcing strips. The protrusion 22 may comprise Keder™, which is a heavy duty coated polyester fabric welded to a cord of solid PVC material.

In alternative embodiments, the edge of the panel 21 does not have to be wrapped around a protrusion 22. Instead, the protrusion could comprise an extruded strip that is bonded to the panel 21. This protrusion could have a V-shaped extension in which the edge of the panel 21 is received. In these embodiments, the protrusion typically comprises Sunprene™, which is described and defined above.

Preferred embodiments of protrusion 22 provide a strong flexible and slippery track welting that slides easily and can bend around corners.

FIG. 5 shows the ends of two frame members 10, each of which is attached to a respective arm of an L-shaped connector 35, so that the frame members 10 are mutually perpendicular.

Various view of the connector 35 are shown in FIGS. 11 to 15. The connector's rear surface (see FIGS. 11 and 13) is shaped to match the front surface of the frame members (the upper surface in the FIG. 4 view). The rear surface of the connector 35 has a flat, planar portion 36 on the outer sides of the L-shape, the flat portion 36 being adapted to receive the front of the flange portion 14. The connector 35 also has a curved semi-circular channel 37 along the inner sides of the L-shape, adapted to receive the front half of the panel-receiving portion 12 (the upper half in the FIG. 4 view).

FIGS. 5 to 7 show the frame member 10 coupled to the connector 35. The frame members 10 are slid into engagement with the arms of the connector, with the panel-receiving portions in the channel 37, and the flanges abutting the flat portions 36.

The inside edge of the channel 37 and the outside edge of the flat portion 36 are provided with respective overhanging lips 42, 44, to retain the frame members in position, "inside" and "outside" being defined relative to the inner and outer corners of the L-shape. The lip 44 is best shown in FIG. 8; the lip 44 engages the groove 19 in the flange 14. FIG. 9 shows the lip 42, which overhangs the end of the front half of the c-shaped panel-receiving portion 12.

It should be noted that the connector 35 is not an essential element of the invention, as the frame members 10 are not necessarily connected to each other at all, and if they are, an alternative way of connecting the frame members 10 could be used.

Figure 17:
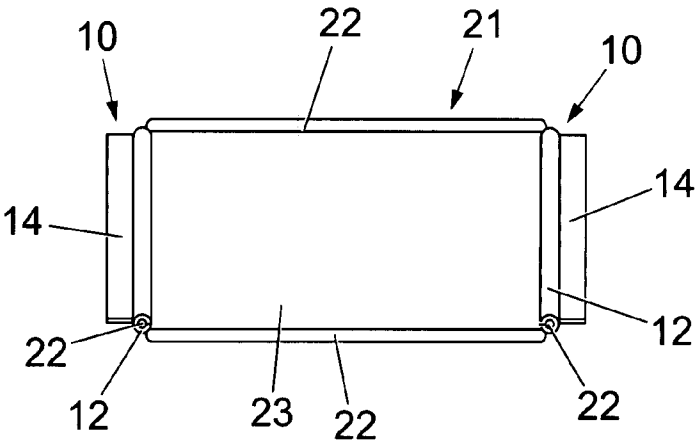

The mounting of an advertising panel 21 on a structure 55 will now be explained with reference to FIGS. 16 to 18. The structure 55 may be a stationary structure, or it may form part of a vehicle. FIG. 17 shows an embodiment of an advertising panel 21 to be mounted; the panel 21 is rectangular and has a planar portion 23 and a respective protrusion 22 attached to each edge of the planar portion 23.

Figure 16:
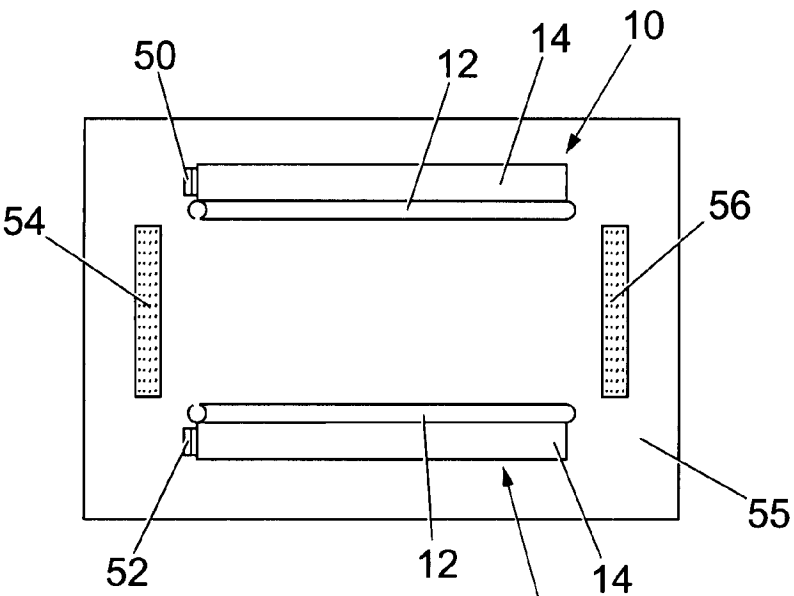

Referring to FIG. 16, a respective "base" fastener is adhered to the structure 55 for each edge of the panel 21; two base fasteners 50, 52 horizontally, and two further base fasteners 54, 56 vertically, at locations defined by the height and width of the panel. The term "base fastener" is used to mean a fastener with which the fastener 20 on the flange 14 can engage. The base fastener and the fastener 20 together comprise a mutually engageable fastening means.

Next, two frame members 10 are attached to the horizontal fasteners 50, 52; this stage is shown in FIG. 16. Because the flanges 14 are flexible, only one person is needed to engage the fasteners 20 with the base fasteners 50, 52, as will now be explained.

As shown in FIG. 18, the fasteners 20, 50 are pushed together at one end of the flange 14 first, causing the mushroom-shaped barbs at that end to interlock. The flange 14 bends so that the part of the fastener 20 to which pressure is applied is pushed downwards to engage the fastener 50, whilst the rest of the fastener 20 is still not engaged.

Next, the pressure is transferred from the end of the flange 14 along the flange 14, to engage successively more of the barbs. This is typically done by pushing a roller along the length of the flange 14, whilst applying downwards pressure to the roller. This causes successive barbs of the fastener 20 to engage with the barbs of the fastener 50, as these are pushed downwards in turn by the roller. The movement of the roller is indicated by the arrow F in FIG. 18. It should be noted that this step does not require a roller; manually pushing the fasteners 20, 50 together also achieves a good result.

The flange 14 being flexible allows a specific part of the fasteners 20, 50 to be engaged, even when the rest of the fasteners are not engaged. Therefore, a single person pushing on a specific location of the flange 14, can cause the barbs at that location to engage, regardless of the other barbs. If the flange 14 was rigid, the fasteners 20, 50 would need simultaneous pressure along the entire length of the flange 14, to engage the fasteners 20, 50. This could not be done simply by one person, and would need either a complex mechanical aid, or many people working together.

The flexibility of the frame and the mutual engagement strength of the first and second fasteners 20, 50 is such that the fasteners 20, 50 can be disengaged by peeling action. The end of the frame member 10 is pulled at an angle relative to the plane of the fastener 50, causing the frame member 10 to bend, and the barbs of the fastener 20 to disengage from the barbs of the fastener 50.

Although the above refers specifically to the fastener 50, the fastener 52 is engaged in exactly the same way.

Next, two further frame members 10 are attached to the vertical protrusions 22 of the panel 21, by aligning the slot 18 with the planar portion 23 and threading the protrusion 22 into the bore 16 starting from one end of the frame member 10. The result of this is shown in FIG. 17.

Next, the advertising panel 21 is attached to the structure 55, by threading the horizontal protrusions 22 of the panel 21 through the c-shaped panel-receiving portions 12 of the horizontal frame members 10 already attached to the structure 55. This aligns the flanges 14 of the vertical frame members 10 attached to the panel 21 with the vertical base fasteners 50, 52 attached to the structure 55. Finally, the vertical frame members 10 are attached to the vertical fasteners 54, 56, in the same way as the horizontal fasteners 50, 52 were attached to their respective frame members 10 (see FIG. 18).

To change the advertising panel, the above steps can be reversed; (i.e. the vertical frame members 10 can be pulled apart from their base fasteners 54, 56, and the horizontal protrusions can be then slid out of their panel-receiving portions 12, etc.). Since the protrusions of the advertising panel can be slid into and out of the panel-receiving portions 12, the advertising panel can be said to be releasably engageable with the frame members 10. The horizontal frame members 10 may also be detached from their base fasteners 50, 52, if desired.

In this way, the advertising panel 21 can be mounted and removed very easily by a single person. The c-shaped panel-receiving portions provide a secure mounting.

The mutually engageable fastening means 20, 50, provides a number of options regarding what stage each of the frame members 10 is attached to the structure 55.

In an alternative method, all four of the frame members 10 are slid into engagement with their respective protrusions before any of the frame members 10 are attached to the structure 55. In this method, the corner connectors 35 can be connected to the frame members at this stage, before the frame members 10 are attached to the structure 55.

The detachable mechanical fastening of the frame members 10 to the structure 55 enables each edge of the panel 21 to be attached securely in a track of a frame member, which could not be done if the frame members were permanently welded to the structure 55.

It should be noted that the order of the steps shown in FIGS. 16 and 17 could be reversed. Furthermore, it is not necessarily the horizontal frame members 10 that are attached to the structure 55 first, (although this is preferable, as it allows the advertising panel to be supported by the upper frame member 10 whilst the vertical frame members 10 are being attached). Alternatively, the vertical frame members 10 could be attached to the structure 55 before being attached to the panel 21, and the horizontal frame members 10 could be attached to the advertising panel 21 before being attached to the structure 55.

In a further alternative method, only one frame member 10 (e.g. the upper frame member) is initially attached to its respective base fastener. Then, the advertising panel 21 is attached to the mounted frame member, and the other edges of the advertising panel 21 are attached to further frame members 10; these steps could occur in either order. Next, the advertising panel 21 can optionally be tensioned, before mounting the frame member 10 that is opposite the initially-attached frame member 10 (e.g. the lower frame member) to the structure 55 by its base fastener. Finally, the remaining frame members (e.g. side frame members) are attached to their respective base members, so that the frame is complete on all sides. In this way, it can be ensured that the mounted advertising panel is correctly tensioned and does not sag.

This method also has the advantage that the advertising panel 21 is easier to mount, in comparison to methods in which two opposite frame members 10 are already/permanently attached to the structure 55. There are two reasons for this. Firstly, the advertising panel 21 can be engaged with each frame member 10 sequentially, instead of requiring any simultaneous engagement with two already-mounted frame members 10. Secondly, the advertising panel 21 does not have to be pulled taut to enable simultaneous engagement with two already-mounted frame members 10. Instead, a first edge of the advertising panel 21 can be engaged with the mounted frame member 10 without any tension needing to be applied to the advertising panel 21 at this time. Hence, the above method enables an easier mounting of the advertising panel 21 that can be accomplished by only one person.

To remove the advertising panel 21 from the structure 55, typically, all of the frame members 10 are peeled away from their respective base members. Alternatively, one or two of the frame members 10 are left mounted on the structure 55, and the advertising panel 21 is slid out of engagement with these mounted frame members 10.

In a preferred method, only one frame member 10 remains mounted on the structure 55, whilst the other frame members 10 are peeled away. The former advertising panel 21 is slid out of engagement with the peeled-away frame members 10, and the replacement advertising panel 21 is engaged with these frame members 10. The remaining edge of the replacement advertising panel 21 is then slid into engagement with the mounted frame member 10. The replacement advertising panel 21 is typically tensioned, and the frame member 10 opposite the frame member 10 that remained mounted on the structure 55 is then attached to its respective base member so that the replacement advertising panel 21 is pulled taut. The rest of the method is as described above.

The invention is not limited to rectangular advertising panels. For example, in the case of buses, advertising panels are typically t-shaped, as shown in FIG. 20.

Figure 20:
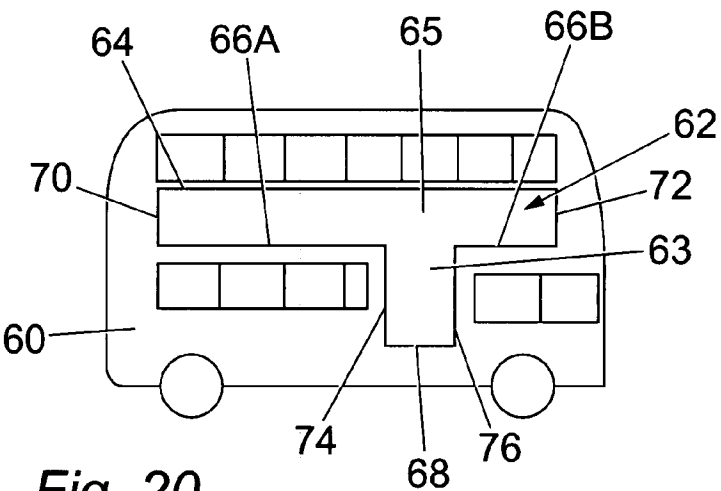

FIG. 20 shows a bus 60 having a T-shaped advertising panel 62. Preferred embodiments of the panel 62 are flexible and can be rolled up when not in use. The advertising panel 62 comprises a vertical trunk 63 and a horizontal branch 65. The horizontal branch 65 has three horizontal edges 64, 66A, 66B; a fourth horizontal edge is provided at the bottom of the vertical trunk 63. The horizontal branch has two vertical edges 70, 72, and the vertical trunk 63 has a further two vertical edges 74, 76.

Other than the different shape, the advertising panel 62 is the same as the panel 21, also having protrusions on each edge.

The t-shaped advertising panel 62 is attached to a structure (in this example, the bus 60) in the same way as the rectangular advertising panel 21 is attached. One frame member 10 is again provided for each edge of the advertising panel 62.

First, base fasteners are attached (e.g. adhered to the bus) at locations corresponding to the desired mounted locations of the edges of the panel 62. Then, frame members 10 are engaged with the base fasteners corresponding to the edges 64, 66A, 66B, 74, 76 (pressing the barbs into engagement along the entire length of the frame members, e.g. manually or using a roller) as shown in FIG. 18. Optionally, the remaining frame members 10 are threaded over their respective protrusions at edges 68, 70, 72 of the panel 62 at this stage, although this could also be done later.

The protrusions of the horizontal edges 64, 66A, 66B of the horizontal branch 65 are then threaded into the bores in their corresponding frame members attached to the bus 60. Next, the vertical trunk 63 is lifted up and bent to align the protrusions of the vertical edges 74, 76 of the trunk with the bore ends in their corresponding frame members 10. The protrusions are threaded through the bores, so that the vertical trunk 63 eventually lies flat against the bus. If the protrusions at edges 68, 70, 72 have not yet been engaged with their respective frame members 10, this can be done at this stage. The final step is to engage the frame members of edges 68, 70, 72 (attached to the advertising panel 62) with their respective base fasteners.

The above method uses the flexibility of the frame to engage the fasteners, and also the flexibility of the advertising panel 62, so that the vertical trunk 63 can be bent to thread the vertical edges 74, 76 into their respective frame members.

Some embodiments of the invention provide an advertising system in which advertising panels can be easily installed, removed and changed. In preferred embodiments, the frame is removable from the structure. In some embodiments, the frame is attachable to the structure using a relatively thin, unobtrusive fastener attached to the structure. These embodiments do not require any substantial modification to the structure itself, as opposed to the known way of welding a large bulky frame/track system to the structure.

Modifications and improvements can be incorporated without departing from the scope of the invention.

For example, not all of these method steps need to be done in the above order. For example, in an alternative method, more, or all of the frame members are engaged with all of the edges of the panel 62 before any frame member is attached to its respective base member. In this case, the advertising panel 62 would not need to be flexible.

The frame members corresponding to the panel edges 74, 76, are not necessarily attached to the bus before the horizontal protrusions are threaded into the frame members of edges 64, 66A, 66B. In this case, the frame members 74, 76 could be attached to the bus immediately after this step, and the rest of the method could be as described above. Alternatively, at this point, the panel edges 74, 76, 68 could be attached to their frame members 10 and then engaged with their base fasteners.

In one method, only the frame member corresponding to the top edge 64 is attached to its base member before the uppermost protrusion of the panel 62 is received in this frame member. The top frame member can support the weight of the panel 62, whilst the remaining fasteners are secured to their respective base fasteners and to the panel 62, in any suitable order. This allows the advertising panel 62 to be optionally tensioned if desired, before mounting the remaining frame members on the bus 60; thus, the advertising panel 62 can be pulled taut so that it will not sag. In this method, typically, the frame members of panel edges 66A, 66B would be mounted second, as these edges are opposite to the top edge 64.

The above modifications also apply to the rectangular embodiment of FIGS. 16 and 17.

The invention allows the panel 62 to be made as an integral single-piece item, instead of the conventional five or more bus panel portions.

The advertising panels 21, 62 may be flexible or rigid.

In some embodiments, the frame is attachable to the structure by means of a protrusion provided on the frame engaging a recess in the structure; for example, the structure may be provided with an elongate slot adjacent the recess, the slot having an open end, so that the protrusion on the frame can be threaded through the open end of the slot. The slot is narrower than the protrusion so that the protrusion is held within the slot.

As stated above, in the illustrated embodiment, the mutually engageable fastening means comprises a 3M™ Dual Lock™ fastening system, but any other suitable fastening means can be used. For example, the fastening means could be any "hook and loop" type fastener, or any mushroom-type fastener, e.g. where both first and second fasteners have protruding mushroom heads.

An advantage of using the 3M™ Dual Lock™, or a similar interlocking mechanical fastener, is that the frame does not need to be riveted or screwed into the structure. Instead, a part of the fastener is adhered or bonded to the structure.

In some embodiments, the first fastener and the frame may be integrally formed (i.e. formed as one piece).

Other modifications have also been described throughout the specification.

The invention claimed is:

1. An advertising system comprising:

a frame for mounting an advertising panel on a structure, the frame comprising at least one frame member having a flexible flange and a panel-receiving portion, the panel-receiving portion being adapted to releasably engage an advertising panel; and a mutually engageable fastening means comprising first and second fasteners, the second fastener being affixable to the structure;

wherein the first fastener is provided on an attachment face of the flange and is adapted to attach the frame in an attachment direction to the second fastener;

wherein the flexibility of the flange and the mutual engagement strength of the first and second fasteners are such that the frame and first fastener are separable from the second fastener by peeling action;

wherein the first and second fasteners each comprise a strip fastener having a plurality of mushroom-shaped interlocking barbs arranged in rows and columns; and wherein a part of the panel-receiving portion extends beyond the attachment face of the flange in the attachment direction.

2. An advertising system as claimed in claim 1, wherein the panel-receiving portion is adapted to receive an edge of an advertising panel.

3. An advertising system as claimed in claim 1, wherein the flexible flange and the panel-receiving portion comprise different materials.

4. An advertising system as claimed in claim 1, wherein the panel-receiving portion is more rigid than the flexible flange.

5. An advertising system as claimed in claim 1, wherein the panel-receiving portion comprises a recess for receiving a protrusion on an advertising panel edge.

6. An advertising system as claimed in claim 5, wherein the recess comprises an elongate slot for retaining the protrusion in the slot whilst allowing a planar part of the advertising panel to extend through the slot.

7. An advertising system as claimed in claim 1, wherein the first and second fasteners are releasably engageable.

8. An advertising system as claimed in claim 1, wherein the first and second fasteners are engaged by pushing the first and second fasteners together and disengaged by pulling them apart.

9. An advertising system as claimed in claim 1, wherein, in one of the first and second fasteners, the rows and columns form straight lines, and in the other fastener, the mushroom-shaped barbs are arranged in non-straight lines.

10. An advertising system as claimed in claim 1, wherein the mutually engageable fastening means includes two interlocking fastener components, each component having a series of stems with mushroom heads, the stems and mushroom heads on one component are adapted to interlock with the stems and mushroom heads on the other component to form a fastening engagement.

11. An advertising system as claimed in claim 1, comprising a plastics material.

12. An advertising system as claimed in claim 1, wherein the at least one frame member comprises a track member.

13. An advertising system as claimed in claim 1, further comprising an advertising panel.

14. An advertising system as claimed in claim 13, wherein the advertising panel is flexible.

15. An advertising system as claimed in claim 13, wherein the advertising panel comprises synthetic paper.

16. An advertising system as claimed in claim 15, wherein the advertising panel comprises vinyl on a polyester mat.

17. An advertising system as claimed in claim 13, wherein the advertising panel comprises a mesh.

18. An advertising system as claimed in claim 13, wherein the advertisement panel is translucent.

19. An advertising system as claimed in claim 13, wherein one frame member is provided for each edge of the advertising panel.

20. An advertising system as claimed in claim 13, wherein the advertising panel is T-shaped, and wherein one frame member is provided for each edge of the T-shape.

21. An advertising system comprising:

an advertising panel;

a frame for mounting the advertising panel on a structure, the frame being releaseably engagable with the advertising panel and comprising at least one frame member having a flexible flange and a panel-receiving portion;

a mutually engageable fastening means comprising first and second fasteners, the second fastener being affixable to the structure;

wherein the first fastener is provided on an attachment face of the flange and is adapted to attach the frame in an attachment direction to the second fastener;

wherein the flexibility of the flange and the mutual engagement strength of the first and second fasteners are such that the frame and first fastener are separable from the second fastener by peeling action;

wherein the first and second fasteners each comprise a strip fastener having a plurality of mushroom-shaped interlocking barbs arranged in rows and columns; and wherein a part of the panel-receiving portion extends beyond the attachment face of the flange in the attachment direction.

22. An advertising system comprising:

a frame for mounting an advertising panel on a structure, the frame comprising at least one track member having a flexible flange and a panel-receiving portion, the panel-receiving portion being adapted to releasably engage an advertising panel; and a mutually engageable fastening means comprising first and second fasteners, the second fastener being affixable to the structure, wherein the first fastener is provided on an attachment face of the flange and is adapted to attach the frame in an attachment direction to the second fastener, wherein the flexibility of the flange and the mutual engagement strength of the first and second fasteners are such that the track member and first fastener are separable from the second fastener by peeling action;

wherein the first and second fasteners each comprise a strip fastener having a plurality of mushroom-shaped interlocking barbs arranged in rows and columns; and wherein a part of the panel-receiving portion extends beyond the attachment face of the flange in the attachment direction.

23. An advertising system comprising:

a frame for mounting an advertising panel on a structure, the frame comprising at least one frame member; and a mutually engageable fastening means comprising first and second fasteners, the second fastener being affixable to the structure;

wherein the frame member comprises a flexible portion and a panel-receiving portion, the flexible portion comprising a first material and the panel-receiving portion comprising a second, less flexible material;

wherein the first fastener is provided on a flexible part of the frame, the flexibility of the frame and the mutual engagement strength of the first and second fasteners being such that the frame and first fastener are separable from the second fastener by peeling action.

* * * * *